US006220664B1

(12) United States Patent
Lee

(10) Patent No.: US 6,220,664 B1
(45) Date of Patent: Apr. 24, 2001

(54) BASE STRUCTURE FOR CHAIR SEAT

(76) Inventor: Ming-Hao Lee, No. 103-1, Section 4, Yuan Lu Road, Pu Hsin Hsiang, Chang Hua Hsien (TW)

( * ) Notice: Subject to any disclaimer, the term of this patent is extended or adjusted under 35 U.S.C. 154(b) by 0 days.

(21) Appl. No.: 09/383,462

(22) Filed: Aug. 26, 1999

(51) Int. Cl.[7] ..... A47C 1/024

(52) U.S. Cl. ..... 297/301.7; 297/301.3; 297/383

(58) Field of Search ..... 297/292, 299, 297/300.8, 301.3, 301.5, 301.6, 301.7, 302.7, 363, 383

(56) References Cited

U.S. PATENT DOCUMENTS 2,329,327 * 9/1943 Boerner ..... 297/383
3,601,444 * 8/1971 Doerner ..... 297/301.3
3,709,535 * 1/1973 Rothermel ..... 297/302.7 X
4,221,430 * 9/1980 Frobose ..... 297/353
5,664,834 * 9/1997 Hsu ..... 297/300.8 X

* cited by examiner

*Primary Examiner*—Peter R. Brown
(74) *Attorney, Agent, or Firm*—Alan Kamrath; Rider Bennett Egan & Arundel, LLP.

(57) ABSTRACT

A base structure for a chair seat includes a base mounted to an underside of the chair seat. Two lateral walls of the base include aligned vertical slots. A first pin is slidably extended through the aligned vertical slots. One of the lateral walls includes a retaining slot with a number of vertical retaining positions. The other of the lateral walls includes a guiding slot in alignment with the retaining slot A swivel seat includes a first end pivotally mounted between the lateral walls of the base by a second pin. The swivel seat is connected to an end of a backrest to pivot therewith. An adjusting rod has a first operative end and a second end extended through a second end of the swivel seat and the lateral walls of the base. The second end of the adjusting rod is releasably engaged with one of the vertical retaining positions, thereby allowing adjustment of an inclination angle of the backrest relative to the seat.

20 Claims, 8 Drawing Sheets

BASE STRUCTURE FOR CHAIR SEAT

BACKGROUND OF THE INVENTION

1. Field of the Invention

The present invention relates to a base structure for a chair seat that allows rapid adjustment in the inclination angle of the backrest relative to the chair seat as well as rapid adjustment of distance between the backrest and the chair seat.

2. Description of the Related Art

A chair is often provided with an adjusting device for adjusting the inclination angle of the backrest relative to the seat, yet the adjustment is limited. Namely, the backrest can only be adjusted to two or three different inclined positions relative to the seat. In addition, the distance between the seat and the backrest is also not adjustable. The present invention is intended to provide an improved base structure for a chair seat that mitigates and/or obviates the above problems.

SUMMARY OF THE INVENTION

It is a primary object of the present invention to provide an improved base structure for a chair seat that allows rapid adjustment in the inclination angle of the backrest relative to the chair seat as well as rapid adjustment of distance between the backrest and the chair seat.

In accordance with a first aspect of the invention, a base structure for a chair seat comprises:

a base adapted to be mounted to an underside of the chair seat, the base including two lateral walls, the lateral walls including aligned vertical slots, a first pin being slidably extended through the aligned vertical slots, one of the lateral walls including a vertical retaining means consisting of a plurality of vertical retaining positions, the other of the lateral walls including a guiding slot in alignment with the retaining means;

a swivel seat including a first end pivotally mounted between the lateral walls of the base by a second pin and a second end, the swivel seat being adapted to connect with an end of a backrest to pivot therewith;

an elastic member pivotally mounted to the swivel seat, the elastic member including a first end engaging the second pin and a second end engaging the first pin; and an adjusting rod having a first operative end and a second end extended through the second end of the swivel seat and the lateral walls of the base, the second end of the adjusting rod being releasably engaged with one of the vertical retaining positions, thereby allowing adjustment of an inclination angle of the backrest relative to the seat.

The vertical retaining positions of the vertical retaining means are formed by a plurality of consecutively connected holes.

The swivel seat includes a horizontal retaining means consisting of a plurality of horizontal retaining positions, and the end of the backrest is connected to the swivel seat by a fastener, wherein the fastener is releasably engaged with one of the horizontal retaining positions, thereby allowing adjustment of horizontal position of the backrest relative to the seat. The horizontal retaining positions of the horizontal retaining means are formed by a plurality of consecutively connected holes. The fastener includes an enlarged head with a diameter greater than that of the holes of the horizontal retaining means, the fastener further including a shank extended from the enlarged head and having a diameter smaller than that of the holes of the horizontal retaining means. The fastener further includes a distal threaded end, and further includes a nut with a screw hole for engaging with the distal threaded end of the fastener, thereby preventing disengagement of the fastener.

In accordance with a second aspect of the invention, a base structure for a chair seat comprises:

a base adapted to be mounted to an underside of the chair seat, the base including two lateral walls, the lateral walls including aligned first vertical slots, a first pin being slidably extended through the aligned first vertical slots, one of the lateral walls including a vertical retaining means consisting of a plurality of vertical retaining positions, the other of the lateral walls including a guiding slot in alignment with the retaining means;

a swivel seat including a first end pivotally mounted between the lateral walls of the base by a second pin and a second end, the swivel seat further including a second vertical slot through which the first pin is slidably extended, the swivel seat being adapted to connect with an end of a backrest to pivot therewith, the swivel seat including a horizontal retaining means consisting of a plurality of horizontal retaining positions, the end of the backrest being connected to the swivel seat by a fastener, the fastener being releasably engaged with one of the horizontal retaining positions, thereby allowing adjustment of the horizontal position of the backrest relative to the seat;

an elastic member including a coil portion pivotally mounted in the swivel seat by a third pin, the elastic member including a first end engaging the second pin and a second engaging the first pin; and an adjusting rod having a first operative end and a second end extended through the second end of the swivel seat and the lateral walls of the base, the second end of the adjusting rod being releasably engaged with one of the vertical retaining positions, thereby allowing adjustment of an inclination angle of the backrest relative to the seat.

In accordance with a third aspect of the invention, a base structure for a chair seat comprises:

a base adapted to be mounted to an underside of the chair seat; and a swivel seat connected to the base, the swivel seat including a horizontal retaining means consisting of a plurality of horizontal retaining positions, an end of the backrest being connected to the swivel seat by a fastener, the fastener being releasably engaged with one of the horizontal retaining positions, thereby allowing adjustment of horizontal position of the backrest relative to the seat.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
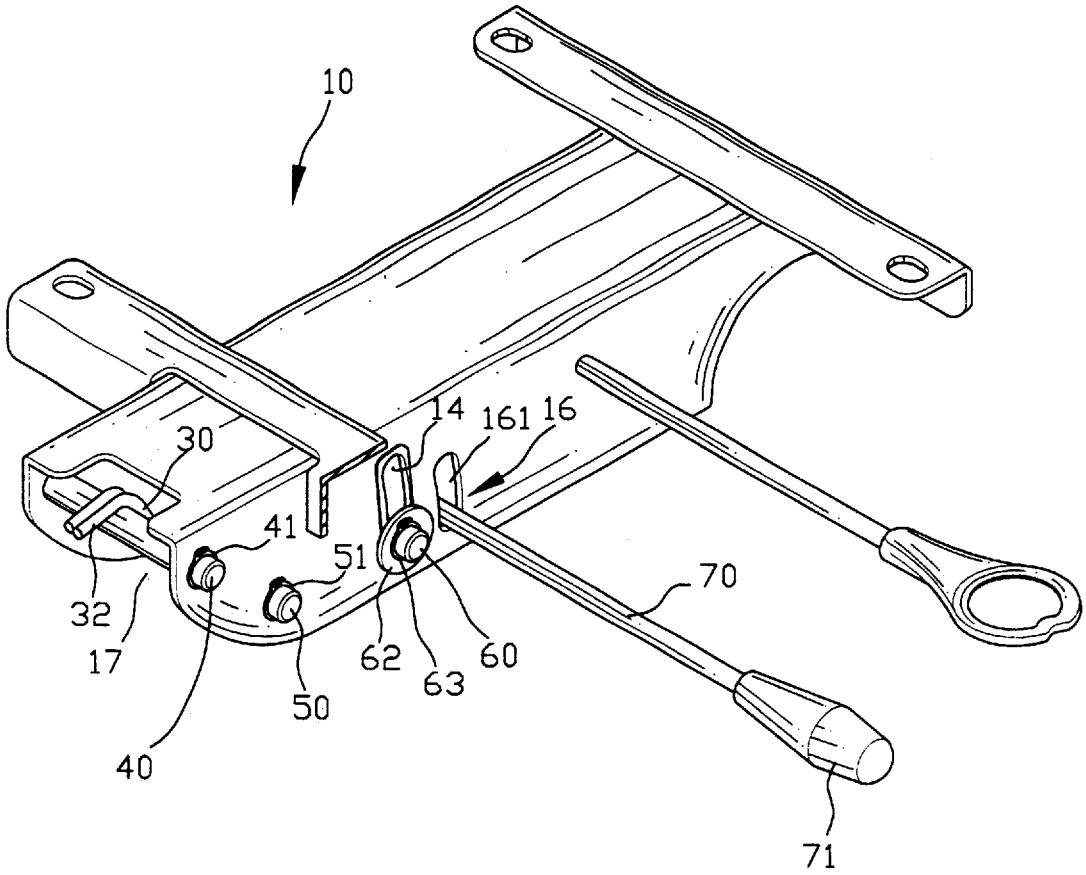
FIG. 1 is a perspective view of a chair seat base structure in accordance with the present invention.
Figure 2:
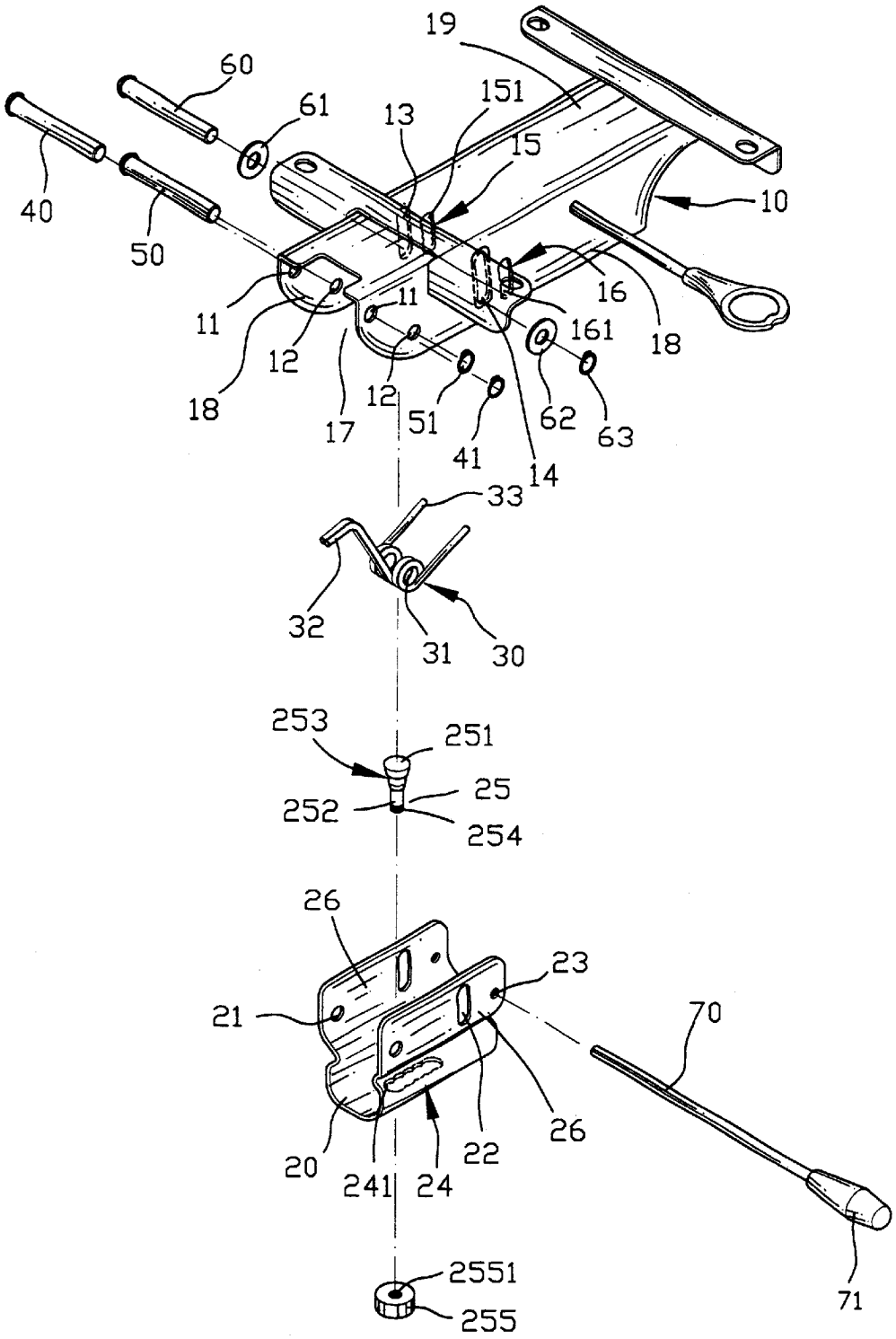
FIG. 2 is an exploded perspective view of the chair seat base structure in accordance with the present invention.

Referring to FIGS. 1 and 2, a chair seat base structure in accordance with the present invention generally includes a substantially U-shape base 10 mounted to an underside of a chair seat (FIG. 5, not labeled) and having two lateral walls 18 extended from a top wall 19, thereby defining a compartment 17 therebetween. The lateral walls 18 include aligned first holes 11 and aligned second holes 12. The lateral walls 18 further including aligned vertical slots 13 and 14. In addition, one of the lateral walls 18 includes a retaining section 15 in the form of a retaining slot 151 consisting of a plurality of consecutively connected retaining holes.

The other lateral wall 18 includes an adjusting section 16 in the form of a guiding slot 161.

The base structure further includes a substantially U-shape swivel seat 20 received in the compartment 17 of the base 10. The swivel seat 20 includes two lateral walls 26 that have aligned pivotal holes 21, aligned slots 22, and aligned holes 23. A bottom wall of the swivel seat 20 includes a retaining slot 24 consisting of a plurality of consecutively connected retaining holes 241.

Figure 5:
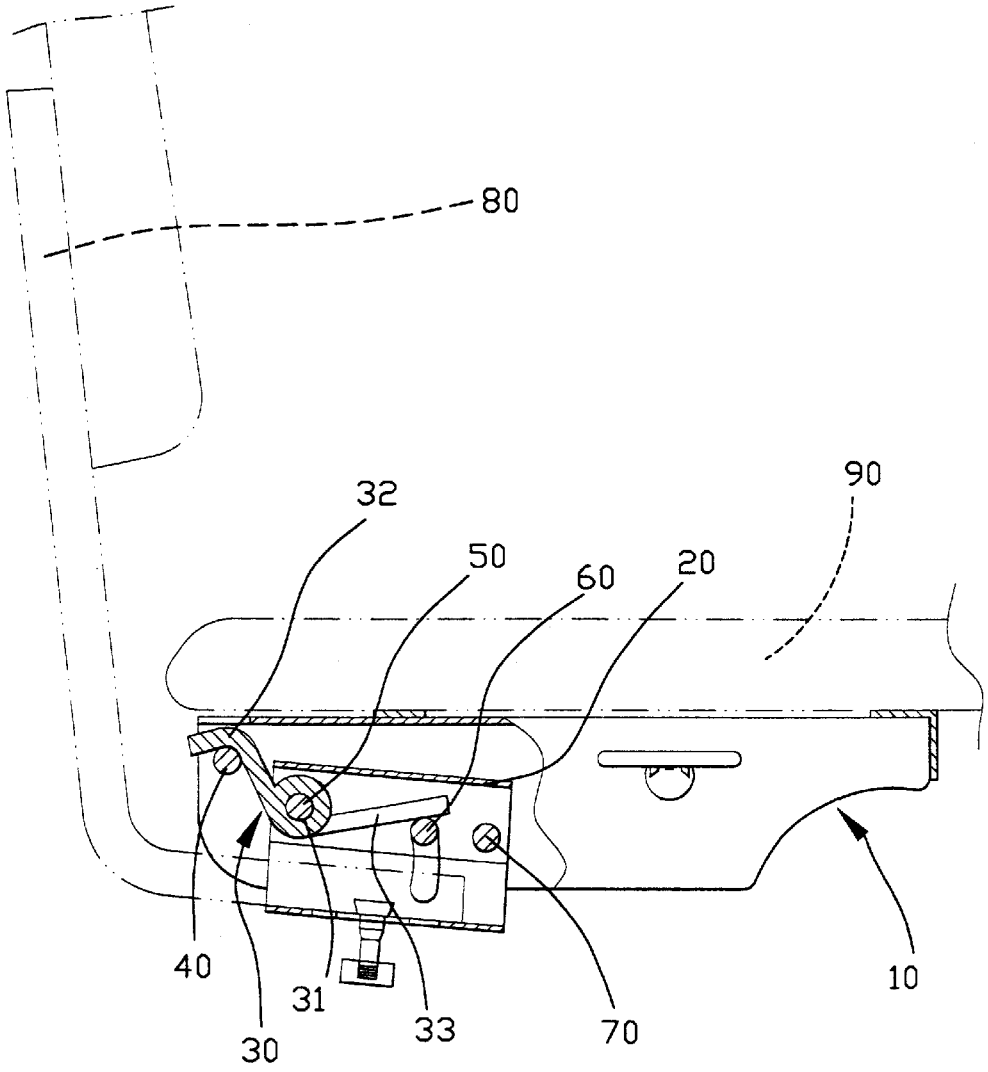
FIG. 5 is a partially sectioned side view of the chair seat base structure in accordance with the present invention.

A fastener 25 includes an enlarged conic head 251, a shank 252 extended from the enlarged head 251, and a distal threaded end 254. The shank 252 is connected to a connecting end of a backrest 80 (FIG. 5) to move therewith. The shank 252 has a diameter smaller than the inner diameter of each retaining hole 241. The enlarged head 251 has a diameter that is greater than the inner diameter of each retaining hole 241. In addition, the enlarged head 251 includes a notched section 253 for releasably engaging with an associated retaining hole 241 to thereby retain the backrest 80 in a desired horizontal position relative to the seat 90 (FIG. 5). A nut 255 with a screw hole 2551 is engaged with the distal threaded end 254 of the fastener 25 to prevent disengagement of the fastener 25.

An elastic member 30 is mounted in the swivel seat 20 and includes a coil portion 31 with a longitudinal hole (not labeled) that aligns with the holes 21 of the swivel seat 20. A pin 50 is extended through the holes 12 of the base 10, the holes 21 of the swivel seat 20, and the longitudinal hole of the coil portion 31 and then retained in place by a C-clip 51. The elastic member 30 further includes a first end with a hook 32 and a second end 33. The hook 32 of the elastic member 30 is engaged with a pin 40 that is extended through the aligned holes 11 of the base 10 and retained in place by a C-clip 41. The second end 33 of the elastic member 30 bears against a pin 60 that is extended through aligned slots 13 and 14 of the base 10 and the aligned slots 22 of the swivel seat 20 and retained in place by a C-clip 63. Washers 61 and 62 are provided to outer surfaces of the lateral walls 18 of the base 10, respectively. An adjusting rod 70 is extended through the aligned holes 23 of the swivel seat 20 and the guiding slot 161 as well as the retaining slot 151. An end of the adjusting rod 70 is provided with an operative handle 71 for manual operation. The other end of the adjusting rod 70 is retained in one of the retaining holes of the retaining slot 151 and thus cannot be moved in the vertical direction.

Figure 3:
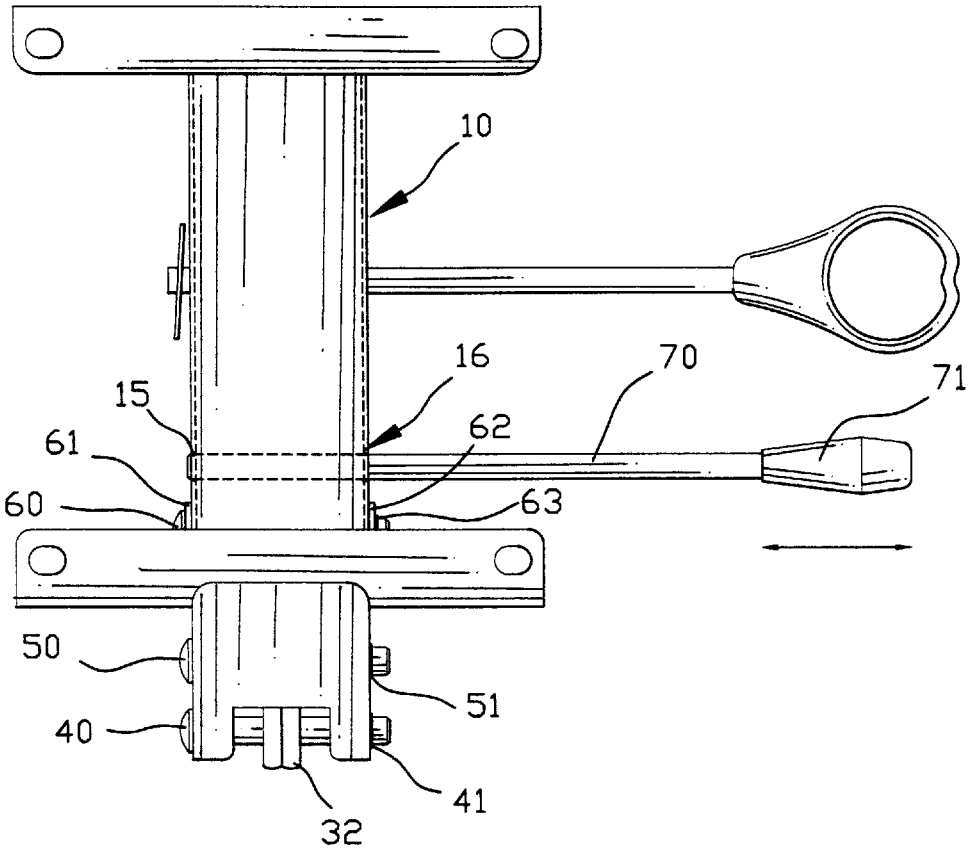
FIG. 3 is a rear view of the chair seat base structure in accordance with the present invention.
Figure 4:
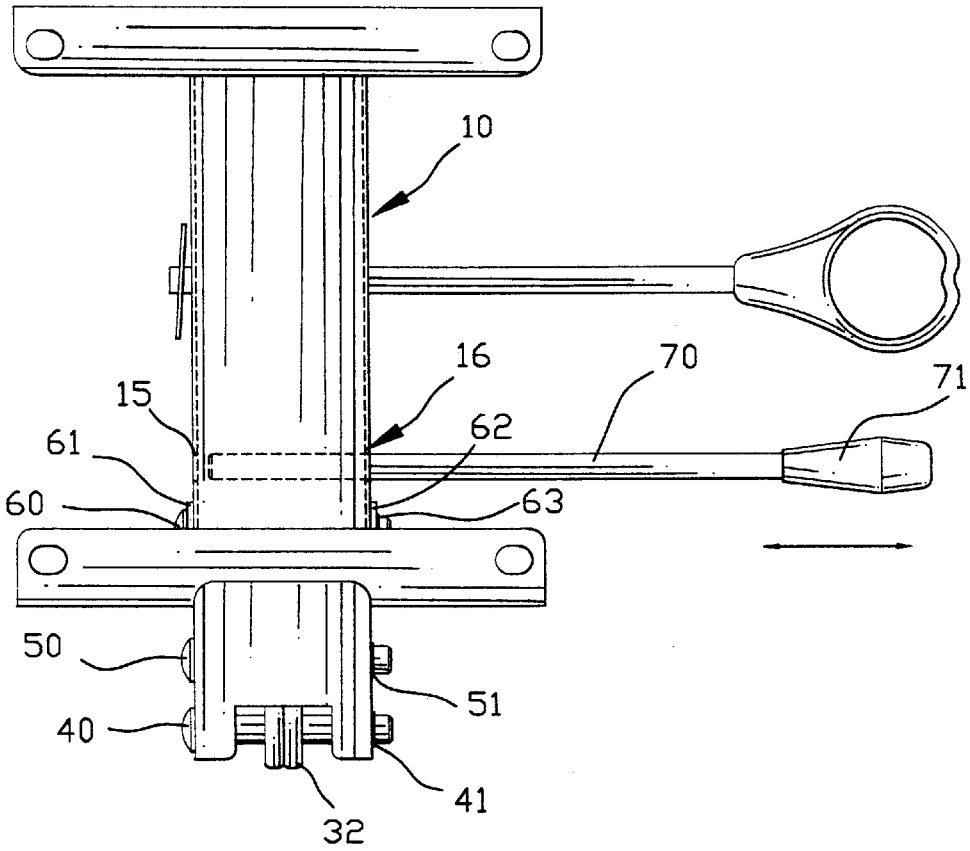
FIG. 4 is a view similar to FIG. 3, illustrating a first step for adjustment in the inclination angle of the backrest.
Figure 6:
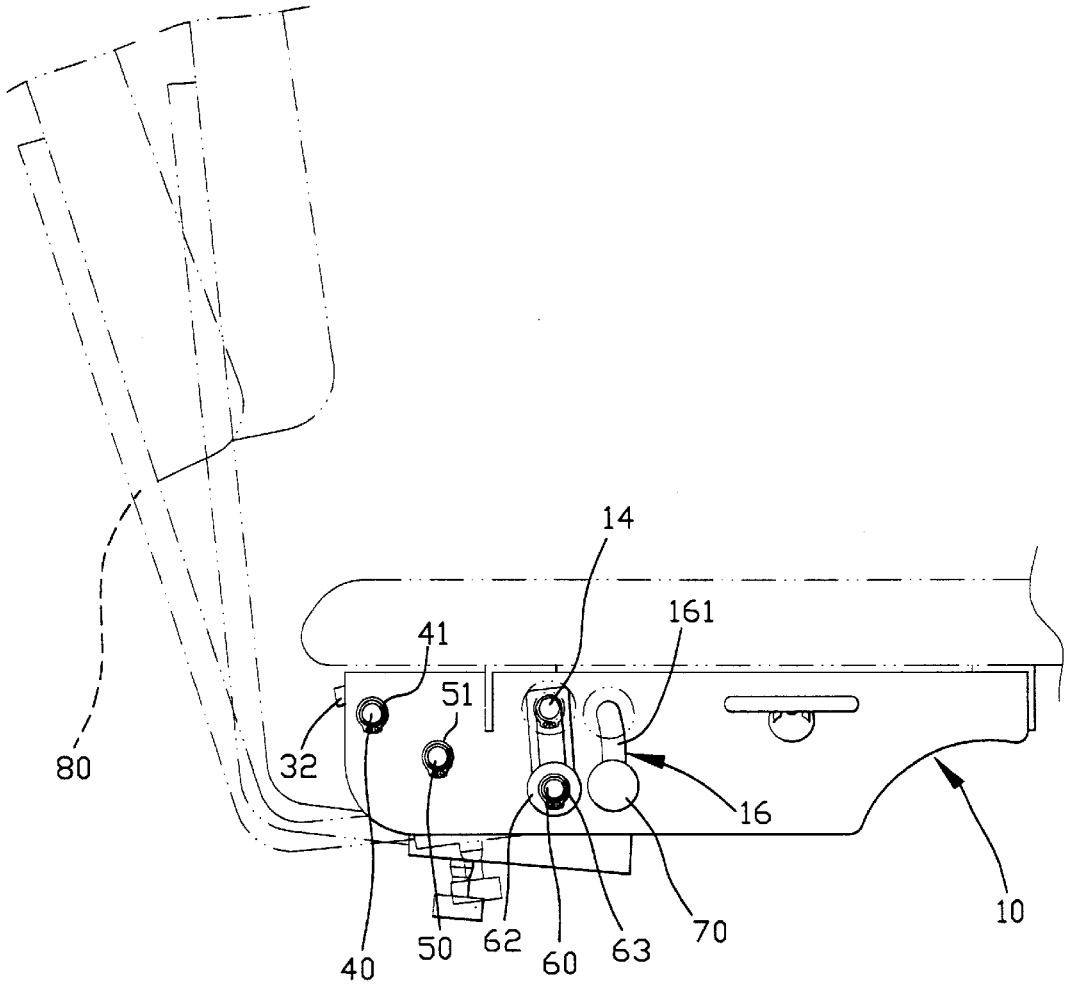
FIG. 6 is a side view of the chair seat base structure in accordance with the present invention, illustrating adjustment in the inclination angle of the backrest.
Figure 7A:
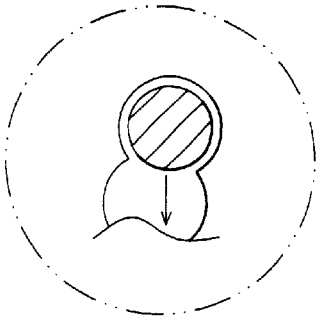
FIG. 7*a* is an enlarged view of a circle in FIG. 7.
Figure 7:
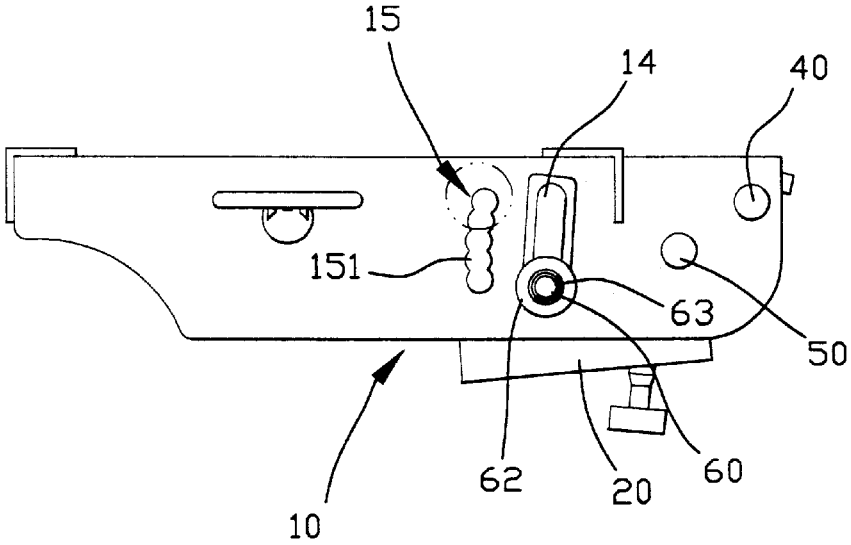
FIG. 7 is a left side view of the chair seat base structure in accordance with the present invention.
Figure 8:
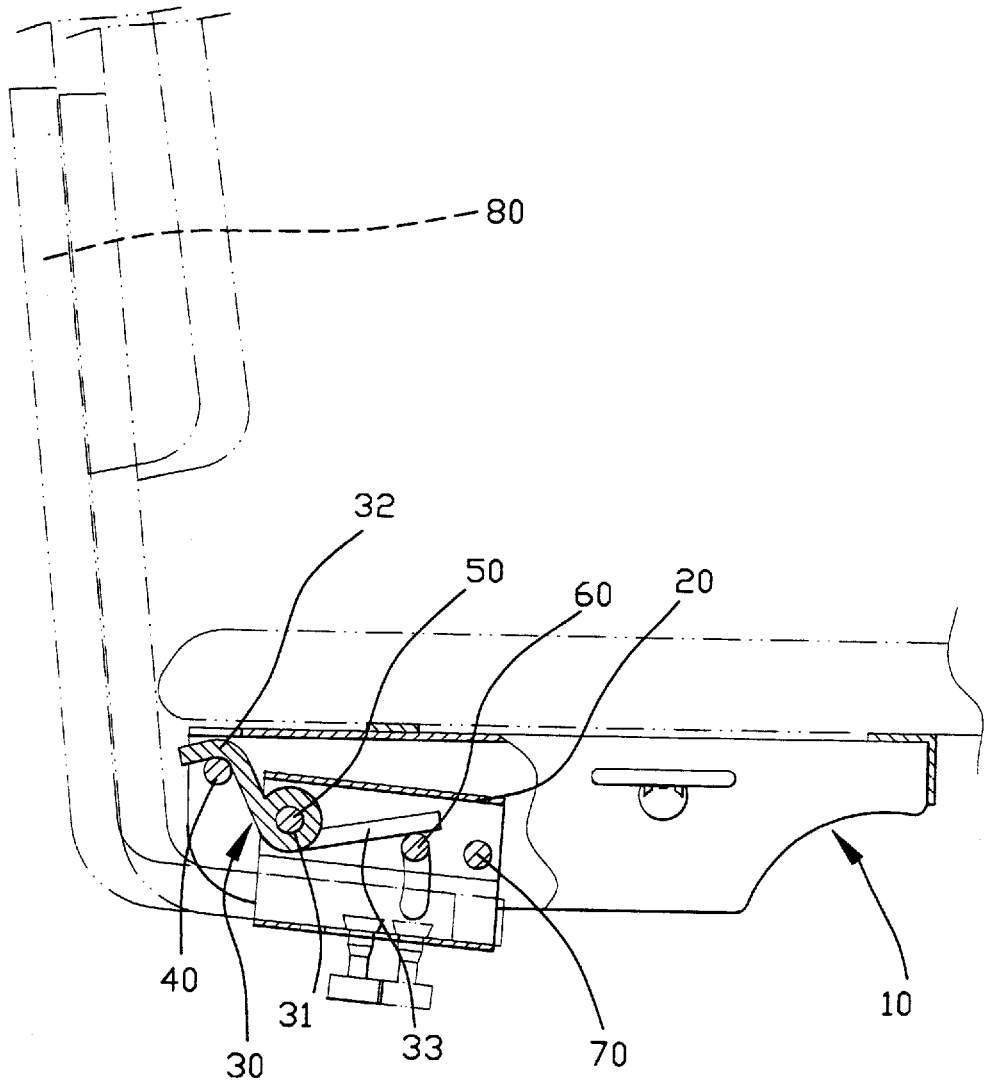
FIG. 8 is a side view of the chair seat base structure in accordance with the present invention, illustrating adjustment in the position of the backrest.

FIG. 3 is a rear view of the base structure of the present invention. When adjustment of inclination angle of the backrest 80 relative to the seat is required, the adjusting rod 70 is pulled outward such that the other end of the adjusting rod 70 disengages from the retaining slot 151, as shown in FIG. 4. Then, the adjusting rod 70 is pushed downward and thus exerts a downward force to cause the swivel seat 20 to pivot about the pin 50. Provision of the slots 13, 14, and 22 (preferably arcuate slots) allows such pivotal movement of the swivel seat 20 relative to the pin 50. As illustrated in FIG. 5, the hook 32 of the elastic member 30 is engaged with the pin 40 and the second end 33 of the elastic member 30 bears against the pin 60. The swivel seat 20 together with the backrest 80 is pivotable relative to the seat 90, best shown in FIG. 6. When the backrest 80 is adjusted to a desired inclination angle relative to the seat 90, the other end of the adjusting rod 70 is moved back to engage with a new retaining hole of the retaining slot 151, as shown in FIGS. 7 and 7*a*. Thus, the backrest 80 can be rapidly adjusted to the desired inclination angle relative to the seat Referring to FIG. 8, when adjustment of the horizontal position of the backrest 80 relative to the seat 90 is required, the fastener 25 is moved upward such that the notched section 253 disengages from the associated retaining hole 241. Next, the fastener 25 together with the backrest 80 are moved horizontally relative to the swivel seat 20 until the backrest 80 and the seat 90 have a desired distance therebetween. Then, the fastener 25 is released and thus falls such that the notched section 253 of the enlarged head 251 engages with a new retaining hole 241.

According to the above description, it is appreciated that the chair seat base structure in accordance with the present invention allows rapid adjustment in the inclination angle of the backrest relative to the chair seat as well as rapid adjustment of distance between the backrest and the chair seat.

Although the invention has been explained in relation to its preferred embodiment, it is to be understood that many other possible modifications and variations can be made without departing from the spirit and scope of the invention as hiereinafer claimed.

What is claimed is:

1. A base structure for a chair seat, comprising:

abase adapted to be mounted to an underside of the chair seat, the base including two lateral walls, one of the lateral walls including a vertical retaining means consisting of a plurality of vertical retaining positions, the other of the lateral walls including a guiding slot in alignment with the retaining means;

a swivel seat including first end pivotally mounted between the lateral walls of the base and a second end, the swivel seat being adapted to connect with an end of a backrest to pivot therewith;

an elastic member for biasing the base relative to the swivel seat; and an adjusting rod having a first operative end and a second end extended through the second end of the swivel seat and the lateral walls of the base, the second end of the adjusting rod being releasably engaged with one of the vertical retaining positions, thereby allowing adjustment of an inclination angle of the backrest relative to the seat.

2. The base structure for a chair seat as claimed in claim 1, wherein the vertical retaining positions of the vertical retaining means are formed by a plurality of consecutively connected holes.

3. The base structure for a chair seat as claimed in claim 2, wherein the lateral walls include aligned vertical slots, with the base including a first pin slideably extended through the aligned vertical slots.

4. The base structure for a chair seat as claimed in claim 3, wherein the swivel seat is pivotally mounted to the base by a second pin.

5. The base structure for a chair seat as claimed in claim 4, wherein the elastic member is pivotally mounted to the swivel seat, with the elastic member including a first end engaging the second pin and a second end engaging the first pin.

6. The base structure for a chair seat as claimed in claim 2, wherein the swivel seat is pivotally mounted to the base by a pin.

7. The base structure for a chair seat as claimed in claim 1, wherein the swivel seat includes a horizontal retaining means consisting of a plurality of horizontal retaining positions, and the end of the backrest is connected to the swivel seat by a fastener, wherein the fastener is releasably engaged with one of the horizontal retaining positions, thereby allowing adjustment of horizontal position of the backrest relative to the seat.

8. The base structure for a chair seat as claimed in claim 7, wherein the horizontal retaining positions of the horizontal retaining means are formed by a plurality of consecutively connected holes.

9. The base structure for a chair seat as claimed in claim 8, wherein the fastener includes an enlarged head with a diameter greater than that of the holes of the horizontal retaining means, the fastener further including a shank extended from the enlarged head and having a diameter smaller than that of the holes of the horizontal retaining means.

10. The base structure for a chair seat as claimed in claim 9, wherein the fastener further includes a distal threaded end, and further including a nut with a screw hole for engaging with the distal threaded end of the fastener, thereby preventing disengagement of the fastener.

11. The base structure for a chair seat as claimed in claim 7, wherein the lateral walls include aligned vertical slots, with the base including a first pin slideably extended through the aligned vertical slots.

12. The base structure for a chair seat as claimed in claim 1, wherein the lateral walls include aligned vertical slots, with the base including a first pin slideably extended through the aligned vertical slots.

13. The base structure for a chair seat as claimed in claim 12, wherein the swivel seat is pivotally mounted to the base by a second pin.

14. The base structure for a chair seat as claimed in claim 13, wherein the elastic member is pivotally mounted to the swivel seat, with the elastic member including a first end engaging the second pin and a second end engaging the first pin.

15. The base structure for a chair seat as claimed in claim 1, wherein the swivel seat is pivotally mounted to the base by a pin.

16. A base structure for a chair seat, comprising:

a base adapted to be mounted to an underside of the chair seat, the base including two lateral walls, the lateral walls including aligned first vertical slots, a first pin being slidably extended through the aligned first vertical slots, one of the lateral walls including a vertical retaining means consisting of a plurality of vertical retaining positions, the other of the lateral walls including a guiding slot in alignment with the retaining means;

a swivel seat including a first end pivotally mounted between the lateral walls of the base by a second pin and a second end, the swivel seat further including a second vertical slot through which the first pin is slidably extended, the swivel seat being adapted to connect with an end of a backrest to pivot therewith, the swivel seat including a horizontal retaining means consisting of a plurality of horizontal retaining positions, the end of the backrest being connected to the swivel seat by a fastener, the fastener being releasably engaged with one of the horizontal retaining positions, thereby allowing adjustment of horizontal position of the backrest relative to the seat;

an elastic member including a coil portion pivotally mounted in the swivel seat by a third pin, the elastic member including a first end engaging the second pin and a second engaging the first pin; and an adjusting rod having a first operative end and a second end extended through the second end of the swivel seat and the lateral walls of the base, the second end of the adjusting rod being releasably engaged with one of the vertical retaining positions, thereby allowing adjustment of an inclination angle of the backrest relative to the seat.

17. The base structure for a chair seat as claimed in claim 16, wherein the vertical retaining positions of the vertical retaining means are formed by a plurality of consecutively connected holes.

18. The base structure for a chair seat as claimed in claim 16, wherein the horizontal retaining positions of the horizontal retaining means are formed by a plurality of consecutively connected holes.

19. The base structure for a chair seat as claimed in claim 18, wherein the fastener includes an enlarged head with a diameter greater than that of the holes of the horizontal retaining means, the fastener further including a shank extended from the enlarged head and having a diameter smaller than that of the holes of the horizontal retaining means.

20. The base structure for a chair seat as claimed in claim 19, wherein the fastener further includes a distal threaded end, and further including a nut with a screw hole for engaging with the distal threaded end of the fastener, thereby preventing disengagement of the fastener.

* * * * *